US005351903A

United States Patent [19]

Mazakas et al.

[11] Patent Number: 5,351,903

[45] Date of Patent: Oct. 4, 1994

[54] ELECTROSTATIC POWDER PAINT GUN WITH TRIGGER CONTROL VARIABLE VOLTAGE

[75] Inventors: Russell Mazakas, 1691 Solano, Ontario, Calif. 91764; Scott Corrothers, San Bernardino, Calif.

[73] Assignee: Russell Mazakas, Ontario, Calif.

[21] Appl. No.: 43,664

[22] Filed: Apr. 6, 1993

[51] Int. Cl.[5] ..... B05B 5/053; B05B 5/03

[52] U.S. Cl. ..... 239/705; 239/707; 239/690; 239/143

[58] Field of Search ..... 239/690, 697, 698, 704, 239/706–708, 143, 705; 118/627, 629

[56] References Cited

U.S. PATENT DOCUMENTS

| | | | |
|---|---|---|---|
| 3,608,823 | 9/1971 | Buschor . | |
| 3,731,145 | 5/1973 | Senay . | |
| 3,819,115 | 6/1974 | Soderman . | |
| 3,844,477 | 10/1974 | Pollard et al. | 239/706 |
| 4,073,002 | 2/1978 | Sickles et al. | 239/690.1 |
| 5,080,289 | 1/1992 | Lunzer | 239/707 |
| 5,186,388 | 2/1993 | Chapman et al. | 239/143 |

FOREIGN PATENT DOCUMENTS

| | | | |
|---|---|---|---|
| 2153260 | 8/1985 | United Kingdom | 239/690 |
| 2172219 | 9/1986 | United Kingdom | 239/690 |
| 2234454 | 2/1991 | United Kingdom | 239/690 |

*Primary Examiner*—Karen B. Merritt

*Attorney, Agent, or Firm*—Blakely, Sokoloff, Taylor & Zafman

[57] ABSTRACT

A hand held electrostatic powdered paint spray gun that has a trigger which allows the user to vary the voltage and the paint density supplied to the gun. The trigger is coupled to a potentiometer that provides an output voltage to circuits that control the flowrate of the paint powder and a voltage supply to the paint powder.

19 Claims, 4 Drawing Sheets

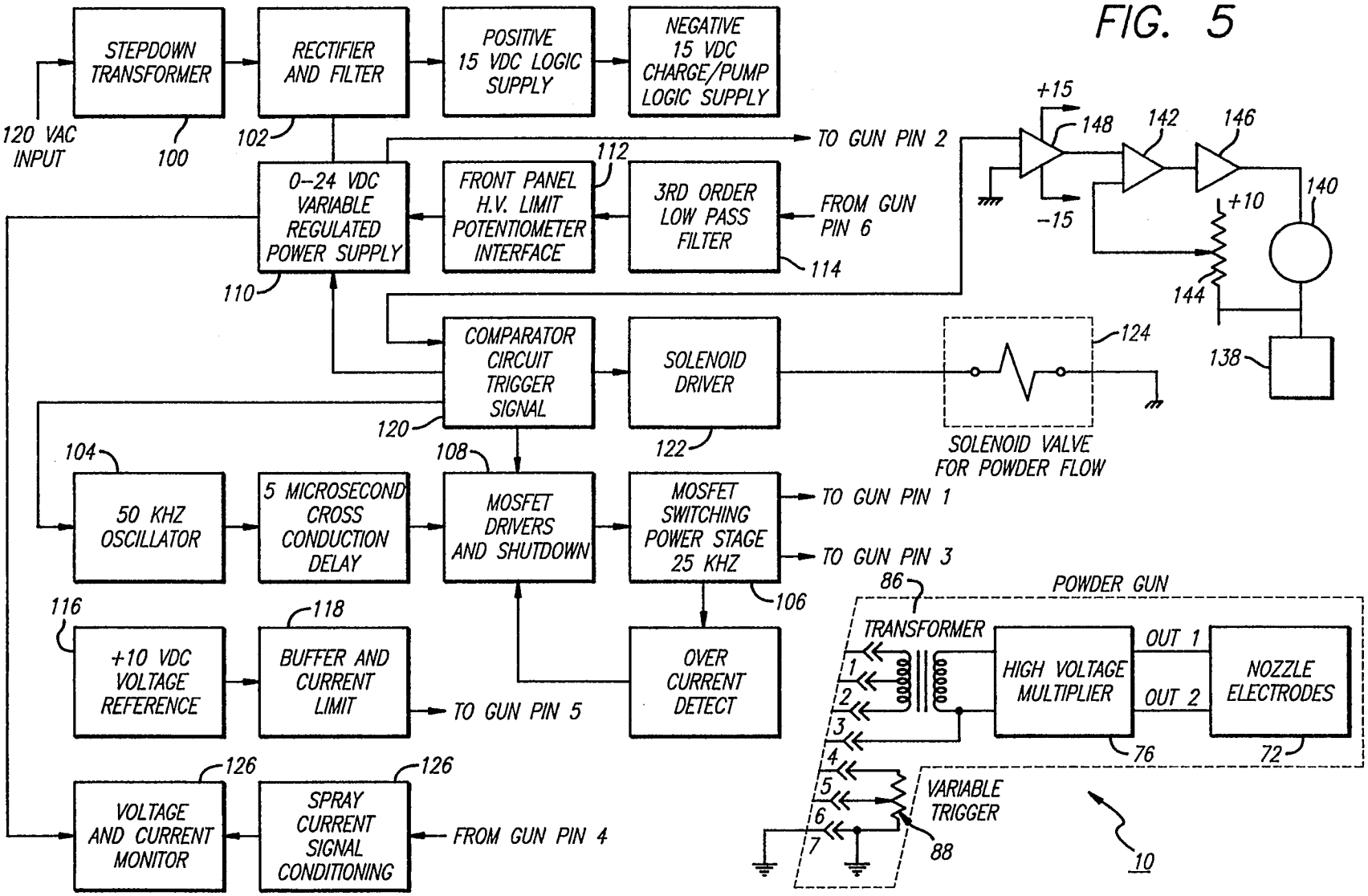
FIG. 5
STEPDOWN TRANSFORMER
100
120 VAC INPUT
RECTIFIER AND FILTER
102
POSITIVE 15 VDC LOGIC SUPPLY
NEGATIVE 15 VDC CHARGE/PUMP LOGIC SUPPLY
0-24 VDC VARIABLE REGULATED POWER SUPPLY
110
TO GUN PIN 2
FROM GUN PIN 6
FRONT PANEL H.V. LIMIT POTENTIOMETER INTERFACE
112
3RD ORDER LOW PASS FILTER
114
+15
-15
148
146
142
140
+10
144
138
50 KHZ OSCILLATOR
104
5 MICROSECOND CROSS CONDUCTION DELAY
COMPARATOR CIRCUIT TRIGGER SIGNAL
120
SOLENOID DRIVER
122
124
SOLENOID VALVE FOR POWDER FLOW
MOSFET DRIVERS AND SHUTDOWN
108
MOSFET SWITCHING POWER STAGE 25 KHZ
106
TO GUN PIN 1
TO GUN PIN 3
OVER CURRENT DETECT
TO GUN PIN 5
+10 VDC VOLTAGE REFERENCE
116
BUFFER AND CURRENT LIMIT
118
VOLTAGE AND CURRENT MONITOR
126
FROM GUN PIN 4
SPRAY CURRENT SIGNAL CONDITIONING
126
POWDER GUN
TRANSFORMER
86
1
2
3
4
5
6
7
VARIABLE TRIGGER
88
HIGH VOLTAGE MULTIPLIER
76
OUT 1
OUT 2
NOZZLE ELECTRODES
72
10

ELECTROSTATIC POWDER PAINT GUN WITH TRIGGER CONTROL VARIABLE VOLTAGE

BACKGROUND OF THE INVENTION

1. Field of the Invention

The present invention relates to hand held electrostatic powdered paint spray guns.

2. Description of Related Art

Electrostatic spray guns are typically used to spray electrostatically charged powdered paint onto an object. The object is connected to ground, so that the charged powdered paint becomes attached to the part. Once the object is covered with the powdered paint, the powder is baked until the paint melts and coats the part.

U.S. Pat. No. 3,608,823 issued to Buschor; U.S. Pat. No. 3,731,145 issued to Senny and U.S. Pat. No. 3,819,115 issued to Soderman disclose electrostatic spray guns used to spray powdered paint. A typical electrostatic spray gun has a housing with an internal passage that allows powdered paint to flow through the gun. A hose couples the internal passage to a pressurized paint source which provides dry powdered paint to the gun. The gun also has a nozzle from which the powdered paint is sprayed onto the object. Adjacent to the nozzle are electrodes which induce a charge on the powdered paint as the powder exits the gun. The electrodes are typically connected to a step up transformer and a voltage multiplier which provide voltages in the range of 80,000 to 100,000 volts. The spray guns typically come equipped with a trigger that can close the electrical circuit of the gun, so that the powdered paint becomes charged by the electrode.

Present electrostatic spray guns are connected to a remote stationary power supply that provides a constant voltage to the gun. In operation, the user sets a predetermined voltage level for the gun and begins spraying the object. The exact value of the voltage level of the gun is not critical when the user is spraying a flat surface, because the distance between the surface of the object and the nozzle of the gun is relatively constant.

The range of acceptable voltage levels narrows when the gun is used on curved surfaces, or objects with grooves or indentations. For example, if the voltage level is too high, the magnetic attraction between the charged powdered paint and the object pulls the powder toward the outside surface of the object closest to the gun. Consequently less powder becomes attached to the surfaces within the channels or indentations of the part. Such a phenomenon is typically referred to as the Faraday cage effect.

The power supplies of most commercially available electrostatic spray guns come equipped with a voltage control that can vary the voltage supplied to the gun. The console of the power supply typically has a knob or other control switch that allows the user to change the voltage to the gun. When a Faraday cage effect occurs, the user can go over to the console and turn down the voltage level of the power supply. Unfortunately this can be a time consuming process, sometimes resulting in two or more trips to the console, until a voltage level is found that will allow the powdered paint to reach into the crevices or indentations of the part. If the parts are moving on a conveyor system, the operator may not have time to continually walk back to the console. It would therefore be desirable to have an electrostatic spray gun which allows the user to efficiently vary the voltage of the gun without having to operate the console of the power supply. Additionally, it would also be desirable to have an electrostatic spray gun system that varies the powder density supplied to the gun as a function of the voltage provided to the gun electrodes, so that an optimum voltage to powder ratio is maintained during the spray cycle of the system.

SUMMARY OF THE INVENTION

The present invention is a hand held electrostatic spray gun that can spray electrostatic powdered paint onto an object. The gun has a housing with an inlet, an outlet and an internal passage that provides fluid communication between the inlet and outlet. The inlet is coupled to a pressurized paint supply which provides dry powdered paint to the gun in a pressurized airstream.

Attached to the housing outlet is a nozzle that contains electrodes which charge the powdered paint as the powder leaves the gun. The nozzle also contains a plurality of secondary flow channels that are coupled to a secondary passage in the housing. The secondary passage and channels provide a secondary flow of air to the outlet of the gun. The secondary flow creates a turbulent flow of charged powdered paint and prevents the powder from accumulating on the electrodes.

The electrodes are connected to a voltage generator and a transformer that provide voltages in the 80,000 to 100,000 volt range. The gun includes a potentiometer that is connected to a trigger. Depressing the trigger moves the potentiometer and varies the voltage across the electrodes. Depressing the trigger also varies the powder density of the paint filled airstream that is supplied to the gun. The powder density is varied in accordance with the voltage provided to the electrodes. If the voltage is decreased then the powder density is decreased. Likewise, if the voltage is increased the paint density is increased. The variation in powder density insures that the powdered paint is adequately charged as the paint exits the nozzle of the gun.

Therefore it is an object of the present invention to provide a hand held electrostatic spray gun that has a variable voltage control that can be operated with a trigger of the gun.

It is also an object of the present invention to provide an electrostatic spray gun system which varies the powdered paint density as a function of the voltage supplied to the spray gun.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 5 is a schematic of an electrical system that can control the voltage and paint density supplied to the spray gun;

DETAILED DESCRIPTION OF THE INVENTION

Figure 1:
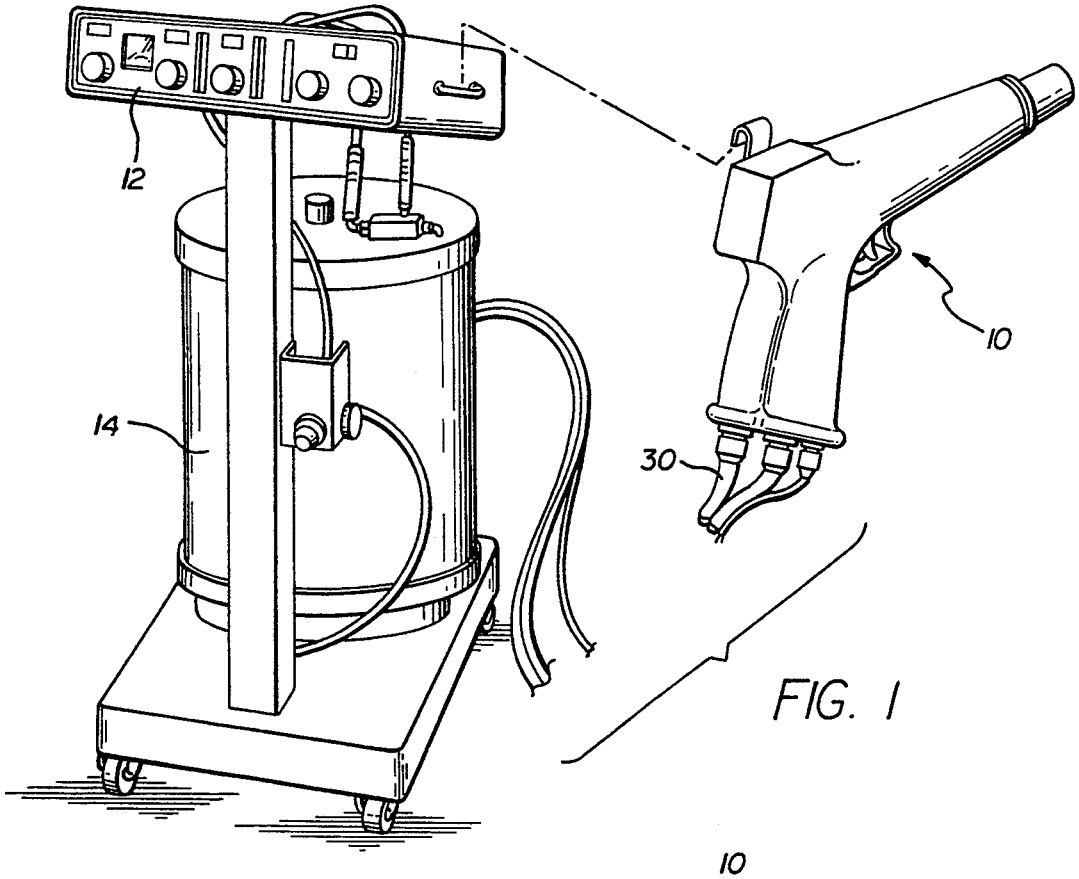
FIG. 1 is a perspective view of an electrostatic powder spray gun system of the present invention.

Referring to the drawings more particularly by reference numbers, FIG. 1 shows an electrostatic powdered paint spray gun 10 of the present invention. The spray gun 10 is typically connected to a power supply 12 and a source of powdered paint 14. The powdered paint source 14 includes a container filled with powdered paint. The powdered paint is fluidized, or suspended in air, with compressed air flowing through a porous bottom wall of the container. An air pump supplies powder, suspended in air, to the gun in a pressurized air stream. The power supply includes a transformer, filter and rectifying circuitry that can receive AC power and output an AC voltage to the gun 10 in the 0–24 V range. The power supply 12 is also typically used to power the powdered paint pump and control a solenoid valve which controls the flow of powdered paint to the gun.

Figures 2, 3:
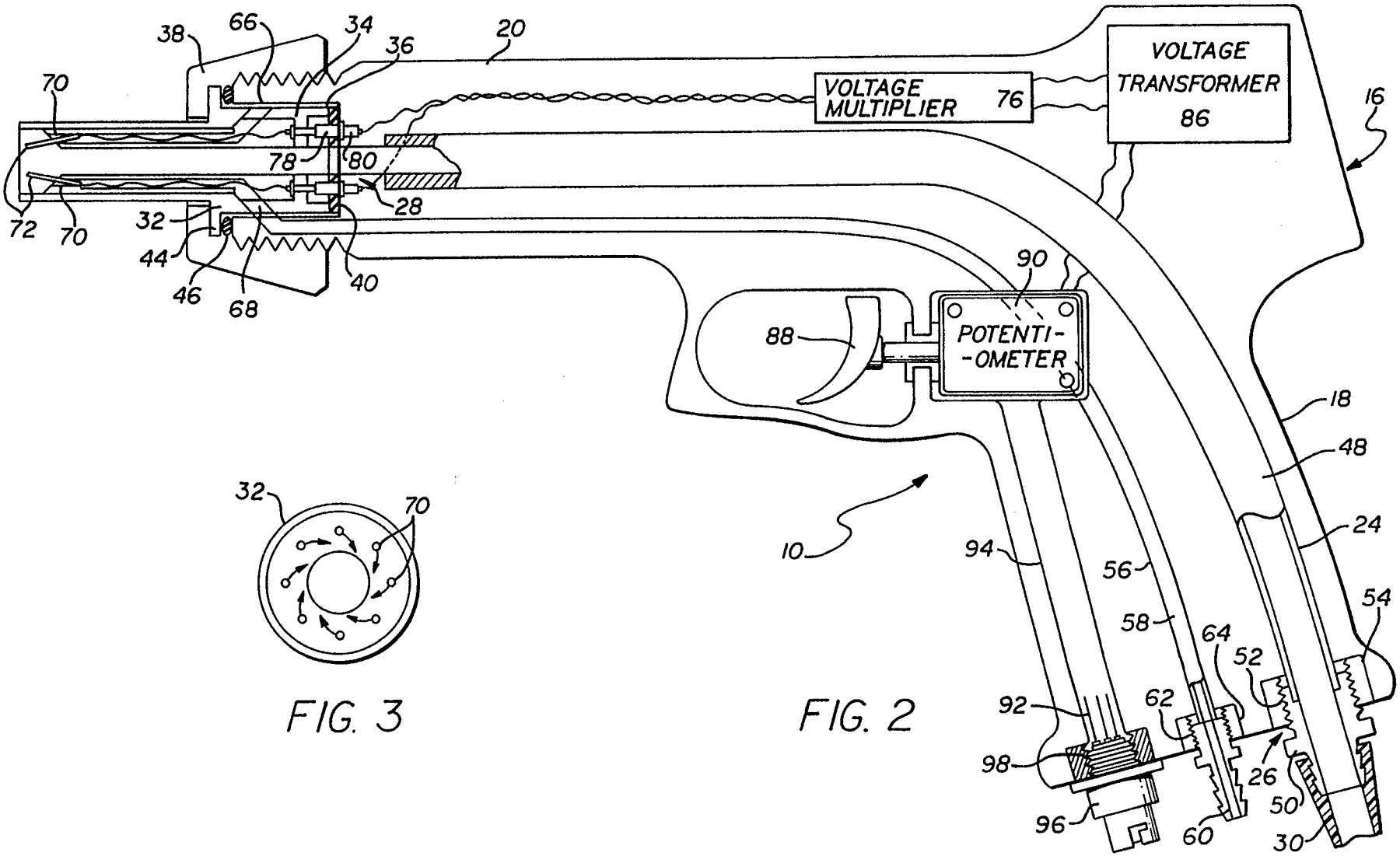
FIG. 2 is a cross-sectional view of the electrostatic powder spray gun of FIG. 1.
FIG. 3 is a front view of the gun of FIG. 2.

FIG. 2 shows a preferred embodiment of the electrostatic spray gun 10. The gun 10 has a housing 16 that is typically constructed as a single molded plastic member. The housing 16 has a handle 18 and barrel 20 that are small enough to allow a user to hold and carry with one hand. The housing 16 is preferably constructed from a dielectric material having a thickness sufficient to insulate and protect the user from the high voltage carried by the gun.

The gun 10 has an inner passage 24 formed in the housing 16. The inner passage 24 has an inlet 26 and an outlet 28. The inlet 26 is coupled to the powdered paint source 14 by a hose 30. The pump of the powdered paint source has a sufficient pressure to blow paint through the inner passage 24 and out of the gun. The outlet 28 is coupled to a nozzle 32 which has a shank portion 34 that is inserted into a bore 36 located at the end of the housing 16. The nozzle 32 is secured to the housing 16 by a cap 38 that screws onto the end of the gun 10. Between the shank portion 34 and the housing 16 is a first gasket 40. The nozzle 32 also has a collar 44 which captures an O-ring 46. The O-ring 46 and gasket 40 seal the nozzle 32, to maintain the air pressure in the inner passage 24 and prevent powdered paint from collecting between the nozzle 32 and the housing 16.

In the preferred embodiment, the gun 10 has a tube 48 which extends through the inner passage 24. The tube 48 is preferably constructed from a material such as Teflon, so that the powdered paint will not impact fuse to the inner walls of the tube 48. The gun 10 is constructed so that the tube 48 can be removed and cleaned. Both the tube 48 and the inner passage 24 have a radius at the intersection of the handle and barrel portions of the gun. The radius allows continuous flow through the gun without significantly changing the momentum of the powdered paint as the powder travels through the passage 24. Such a construction reduces the amount of powdered paint that is retained by the tube, thereby reducing the amount of clogging within the gun. In the preferred embodiment, the radius is typically greater than 90 degrees.

The hose 30 and tube 48 are both connected to a fitting 50 that is attached to the end of the gun. The fitting 50 is typically screwed into a bushing 52 that is pressed into a bore 54 formed in the housing 16. The tube 48 can be removed from the gun by merely unscrewing the fitting 50 from the bushing 52 and pulling the tube 48 out of the housing 16.

The gun has a secondary passage 56 that extends through the housing 16. The passage 56 contains a secondary tube 58 which is coupled to the air supply by a secondary fitting 60. The secondary fitting 60 is preferably screwed into a bushing 62 that is pressed into a bore 64 formed in the housing 16. The secondary passage 56 is in fluid communication with an annular space 66 between the nozzle 32 and the housing 16. The annular space 66 allows air to flow into a plurality of channels 68 that extend through the nozzle 32.

The channels 68 have outlets 70 arranged in the pattern shown in FIG. 3. Four of the channels 68 contain electrodes 72 which provide an electric field across the exit of the gun. The channel outlets 70 are preferably tapered and arranged so that the airstream at the end of the gun has a swirling circular pattern as shown in FIG. 3. The swirling airstream prevents powdered paint from accumulating on the electrodes 72 and creates a turbulent stream of powdered paint that is emitted from the gun.

Figure 4:
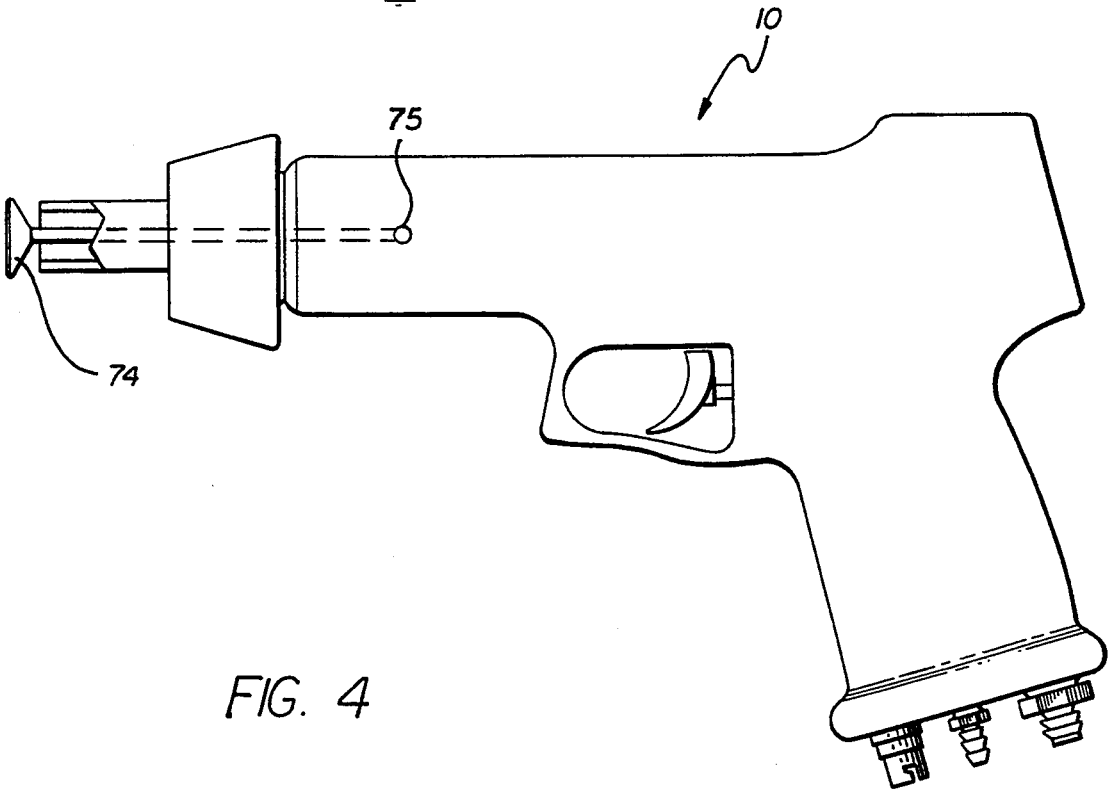
FIG. 4 is a side view of the spray gun with a diffuser.

FIG. 4 shows a gun with a diffuser 74 that extends from the end of the nozzle 32 and is coupled to the housing 16 by a pin 75. The diffuser 74 deflects the powdered paint as the powder exits the gun, thereby increasing the spray area of the gun. The diffuser 74 can be used with or without the channels 68.

The electrodes 72 are connected to a voltage multiplier circuit 76 by a pair of electrical sockets 78 which mate with a pair of electrical pins 80 that extend from the housing 16. The housing 16 also has a guide pin (not shown) which mates with a hole 84 in the nozzle 32 to align the pins 80 with the sockets 78.

The voltage multiplier circuit 76 is connected to a step up transformer 86 which is coupled to the power supply 12. The transformer 86 typically receives a voltage between 0–24 V and provides an output voltage in the 2000 V range. The voltage multiplier circuit 76 typically increases the voltage to a range of 80,000–100,000 V, which is supplied to the electrodes 72. The nozzle 32 is constructed so that electrodes 72 with different potentials are separated from each other by the flow path of the gun. The voltage potential between the electrodes 72 creates an electrical field across the outlet of the gun. When the powdered paint is blown out of the gun, the powder becomes charged by the field. The gun is directed toward an object that has an opposite charge, wherein the charged powder is attracted to the object.

The gun has a variable trigger 88 that is attached to a potentiometer 90. Both the transformer 86 and potentiometer 90 are connected to the power supply 12 by wires 92 that run through a wire passage 94 formed in the housing 16. The wires 92 terminate at an electrical connector 96 that is screwed into a bushing 98 attached to the housing 16. The connector 96 has a male portion and female portion which allows the gun 10 to be electrically connected and disconnected from the power supply 12.

FIG. 5 shows a preferred electrical system of the present invention. The power supply 12 has a step down transformer 100 which is typically connected to a municipal power source that supplies 120 VAC. The power supply 12 also has a rectifier/filter circuit 102 that rectifies the AC power to DC. As described above, the power supply 12 can also supply power to the pump of the powdered paint source 14.

The power supply 12 has an oscillator 104 which is connected to MOSFET 106 and MOSFET driver 108 circuits. The MOSFETs are connected to the step up transformer 86 of the gun by pins P1 and P3. The oscillator 104 provides periodic input signals which switch the MOSFETs between high and low states. When the MOSFETs are in the high state, power is supplied to the transformer 86. When the MOSFETs are in the low state, power is not supplied to the gun. The oscillator/-MOSFET circuits provide a digital to analog conversion between the power supply and the gun, so that the electrodes are receiving AC power.

The rectified power from the rectifier 102 is supplied to a variable regulated power supply 110. The regulated power supply 110 is connected to the step-up transformer 86 by pin P2. The regulated power supply 110 is also connected to a potentiometer interface circuit 112 which controls the upper voltage limit of the power supply 12 and the gun 10. The interface circuit 112 is typically coupled to a control knob which allows the user to vary the upper voltage limit of the gun. The interface circuit 112 is connected to the potentiometer 90 by pin P6 through a low pass filter 114. The potentiometer 90 is also connected to a reference voltage source circuit 116 and current limit circuit 118 by pin P5. The potentiometer 90 is grounded by pin P7.

Depressing the trigger 88 of the gun changes the resistance of the potentiometer 90 and increases the voltage on pin P6. The increase in the pin P6 voltage increases the output voltage from interface circuit 112 to the power supply 110. The output of the interface circuit 112 provides a reference voltage for a linear regulator circuit within the regulated power supply, such that any change in the output voltage of the circuit 112 produces a corresponding linear change in the voltage provided by the power supply 110 to the transformer 86 on pin P2. Increasing the output voltage of the interface circuit 112 causes a corresponding increase in the voltage provided to the transformer 86 and produced by the gun 10.

The interface circuit 112 is preferably constructed so that the output of the gun has a voltage ratio corresponding to the amount of movement of the trigger. For example, when the trigger is depressed 50%, the voltage supplied by the gun is 50% of the upper voltage limit established by the interface circuit 112. The interface circuit 112 is connected to a comparator circuit 120 which compares the output of the circuit 112 with a reference value. When the output voltage of the circuit 112 exceeds the reference value, the comparator 120 enables a solenoid driver 122 which opens a solenoid valve 124 and allows the powdered paint to flow into the gun 10. The reference value is typically set so that the trigger 88 must be depressed approximately 10% before the solenoid is opened and the powdered paint is blown through the gun. Such a lower limit reduces the probabilities of an inadvertent discharge of powdered paint through the gun. The output of the transformer 86 may be connected to voltage and current monitor circuits 126 which monitor the current between the gun and the object that is being sprayed.

Figure 6:
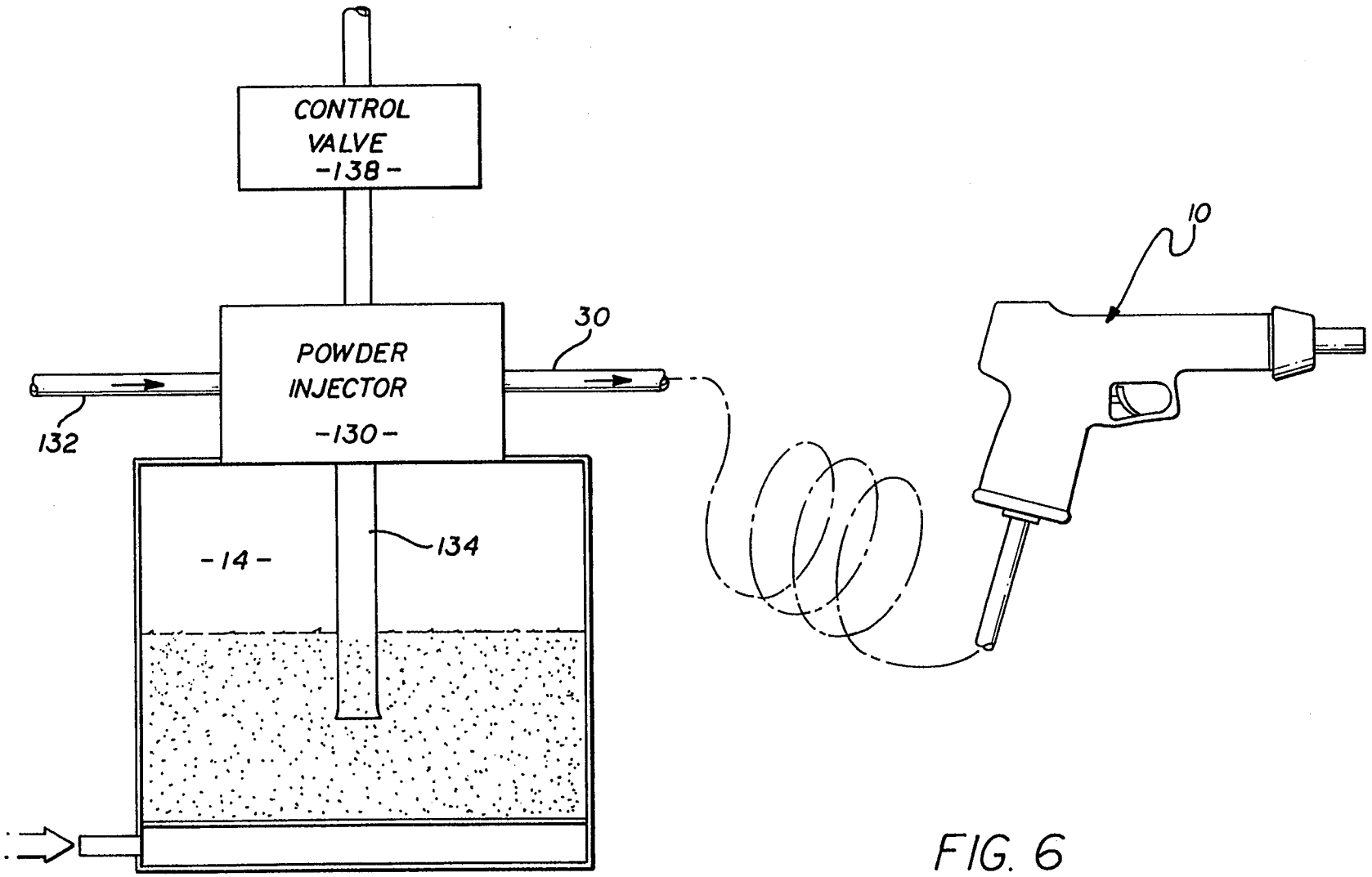
FIG. 6 is a schematic of the spray gun coupled to a container of fluidized powdered paint by a powder injector.

As shown in FIG. 6, the spray gun 10 is preferably coupled to the container 14 by an injector manifold 13C. The manifold 130 receives a main supply of air from the air pump through the main air supply line 132. The fluidized powdered paint is drawn up from the container 14 through the container supply line 134. The powdered paint flows from the manifold 130 and into the gun 10 through tube 30.

A secondary stream of air is introduced to the manifold through secondary air line 136. The flowrate through the secondary air line 136 is controlled by control valve 138. Increasing the secondary air flowrate decreases the amount of powdered paint that is drawn from the container 14 and delivered to the gun 10. Likewise, decreasing the flowrate of air through the secondary air line 136 increases the powdered paint density that is supplied to the spray gun 10.

As shown in FIG. 5, the control valve 138 may be coupled to a servo motor 140 which varies the opening of the valve 138. The servo motor 140 is coupled to a differential amplifier 142 which has a first input connected to the output of the potentiometer interface 112 and a second input connected to a valve position feedback potentiometer 144. The feedback potentiometer 144 senses the mechanical position of the valve 138. The potentiometer 144 resistance value changes as a function of the valve 138 position. The output of the differential amplifier 142 may be amplified by a power amp 146 to a level sufficient to drive the servo motor 140. The system may also include an inverter amp 148 located between the potentiometer interface 112 and the differential amplifier 144.

In operation, the trigger 88 is depressed, which increases the output voltage of the potentiometer interface 112. If the interface 112 output voltage is different than the voltage across the feedback potentiometer 144, a voltage is supplied to the servo motor 140 by the differential amplifier 142 and the power amp 146. The servo motor 140 is energized and the valve is moved to a more open position. Movement of the valve also changes the resistance of the feedback potentiometer 144. Power is supplied to the servo motor 140 until the voltage of the feedback potentiometer 144 equals the voltage of the potentiometer interface 112 output signal.

Movement of the valve 138 varies the secondary air flowrate and the density of powdered paint supplied to the gun 10. The feedback potentiometer 144 and valve 138 are typically adapted so that an optimum amount of powdered paint is delivered to the gun for the full range of voltages supplied to the gun electrodes 72. When the voltage to the electrodes is decreased, the control system induces a corresponding decrease in the powdered paint density delivered to the gun. Supplying an excessive amount of powdered paint may produce an output stream of paint that is not adequately charged by the electrodes.

With the present invention the user can control the voltage and paint density supplied to the gun by simply manipulating a trigger. For example, if the user is spraying an object and comes upon an indentation in the part, the user may partially release the trigger to reduce the voltage of the gun. Reducing the gun voltage, decreases the charge of the powdered paint and the attraction to the oppositely charged object, thereby allowing the powder to flow into the indentation. The system also varies the paint density as a function of the voltage, so that the powdered paint is adequately charged for all voltage settings.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A spray gun that can spray electrostatically charged powdered paint, comprising:

a housing having an inlet, an outlet and an internal passage that provides fluid communication between said inlet and said outlet;

voltage means attached to said housing for providing a voltage and creating an electric field at said outlet of said housing;

input means attached to said housing for varying the voltage of said voltage means;

pressurized paint means for supplying powdered paint to said inlet in a stream of air, and paint control means operatively connected to said input means for varying a powdered paint density of said stream of air when said voltage of said voltage means is varied.

2. The spray gun as recited in claim 1, wherein said input means includes a trigger and voltage control means for varying the voltage of the electric field in response to movement of said trigger.

3. The spray gun as recited in claim 2, wherein said voltage control means includes a potentiometer connected to said trigger and said voltage means.

4. The spray gun as recited in claim 1, wherein said housing internal passage has a radius between a handle portion of said housing and a barrel portion of said housing.

5. The spray gun as recited in claim 1, further comprising a nozzle attached to said outlet of said housing, said nozzle having a plurality of internal channels coupled to a secondary passage within said housing.

6. The spray gun as recited in claim 5, wherein said internal channels have outlets oriented to induce a turbulent airstream at said housing outlet.

7. The spray gun as recited in claim 1, wherein said pressurized paint means includes a manifold having a first inlet coupled to a main supply of air, a second inlet coupled to a secondary supply of air and a third inlet coupled to a container filled with fluidized powdered paint, said manifold further having an outlet coupled to said housing inlet.

8. The spray gun as recited in claim 7, wherein said pressurized paint means includes a control valve that controls a flowrate of said secondary supply of air.

9. A spray gun that can spray electrostatically charged powdered paint, comprising:

a housing having a handle that extends from a barrel portion at an oblique angle, said housing containing an inlet, an outlet and an internal passage that provides fluid communication between said inlet and said outlet, said housing further having a secondary passage extending through said handle and said barrel portion;

pressurized paint means for supplying powdered paint to said inlet in a stream of air;

a nozzle attached to said outlet of said housing, said nozzle having a plurality of internal channels in fluid communication with said secondary passage;

voltage means attached to said housing for providing a voltage and creating an electric field at said outlet of said housing;

a trigger adapted to move relative to said housing; and, voltage control means attached to said trigger for varying the voltage of the electric field in response to movement of said trigger; and, paint control means for varying a powdered paint density of said stream of air supplied to said inlet in response to movement of said trigger.

10. The spray gun as recited in claim 9, wherein said pressurized paint means includes a manifold having a first inlet coupled to a main supply of air, a second inlet coupled to a secondary supply of air and a third inlet coupled to a container filled with fluidized powdered paint, said manifold further having an outlet coupled to said housing inlet.

11. The spray gun as recited in claim 10, wherein said pressurized paint means includes a control valve that controls a flowrate of said secondary supply of air.

12. The spray gun as recited in claim 11, wherein said voltage control means includes a potentiometer connected to said trigger and said voltage means.

13. The spray gun as recited in claim 9, wherein said housing internal passage has a radius between said handle portion of said housing and said barrel portion of said housing.

14. The spray gun as recited in claim 13, further comprising a nozzle seal between said nozzle and said housing.

15. The spray gun as recited in claim 14, further comprising a cap that secures said nozzle to said housing and a cap seal located between said housing and said cap.

16. A spray gun that can spray electrostatically charged powdered paint, comprising:

a housing having an inlet, an outlet and an internal passage that provides fluid communication between said inlet and said outlet;

pressurized paint means for providing powdered paint in a stream of air to said inlet, said powdered paint being provided at a predetermined density;

voltage means attached to said housing for providing a voltage and creating an electric field at said outlet of said housing; and, input means attached to said housing for varying said density of said powdered paint within said stream of air.

17. The spray gun as recited in claim 16, wherein said pressurized paint means includes a manifold having a first inlet coupled to a main supply of air, a second inlet coupled to a secondary supply of air and a third inlet coupled to a container filled with fluidized powdered paint, said manifold further having an outlet coupled to said housing inlet.

18. The spray gun as recited in claim 17, wherein said pressurized paint means includes a control valve that controls a flowrate of said secondary supply of air.

19. A spray gun that can spray electrostatically charged powdered paint, comprising:

a housing having an inlet, an outlet and an internal passage that provides fluid communication between said inlet and said outlet;

a nozzle located at said outlet of said housing, said nozzle having a plurality of internal channels;

a pair of electrodes located within said internal channels;

voltage means attached to said electrodes for providing a voltage and creating an electric field at said outlet of said housing; and, input means attached to said housing for varying the voltage of said voltage means.

* * * * *

UNITED STATES PATENT AND TRADEMARK OFFICE

CERTIFICATE OF CORRECTION

PATENT NO. : 5,351,903

DATED : October 4, 1994

INVENTOR(S) : Mazakas et al.

It is certified that error appears in the above-identified patent and that said Letters Patent is hereby corrected as shown below:

In column 5 at line 62 "13C" should be --130--.

Signed and Sealed this

Thirteenth Day of June, 1995

*Attest:*

*Attesting Officer*

BRUCE LEHMAN

*Commissioner of Patents and Trademarks*